United States Patent [19]

Henager

[11] 4,040,220

[45] Aug. 9, 1977

[54] CONCRETE JOINTS

[75] Inventor: Charles H. Henager, Kennewick, Wash.

[73] Assignee: Battelle Development Corporation, Columbus, Ohio

[21] Appl. No.: 382,519

[22] Filed: July 25, 1973

[51] Int. Cl.[2] ..... E04B 1/00

[52] U.S. Cl. ..... 52/259; 52/659; 52/741

[58] Field of Search ..... 52/251, 259, 659, 722; 106/99

[56] References Cited

U.S. PATENT DOCUMENTS

| | | | |
|---|---|---|---|
| 3,340,667 | 9/1967 | Reiland | 52/722 |
| 3,400,507 | 9/1968 | Macchesney | 52/659 X |
| 3,429,094 | 2/1969 | Romoaldi | 106/99 X |
| 3,616,589 | 11/1971 | Shepard | 52/659 |
| 3,650,785 | 3/1972 | Ball et al. | 106/99 X |

*Primary Examiner*—Price C. Faw, Jr.
*Assistant Examiner*—Carl D. Friedman
*Attorney, Agent, or Firm*—Philip M. Dunson; Kenneth R. Warburton

[57] ABSTRACT

A joint of beam and column-type members comprising essentially concrete of the type wherein intersecting elongate members of reinforcing steel or the like, confined with supporting members in the form of reinforcing hoops, stirrup-ties, supplementary crossties, or the like in the joint region, provide sufficient strength and ductility in the joint to withstand satisfactorily a predetermined amount of reversed flexure. A special concrete mix is prepared with fibers having a modulus of elasticity of at least about 20 million psi substantially uniformly distributed therein with an average spacing between fibers of up to about 0.3 inch and in a quantity sufficient to provide at least a predetermined flexural strength, and the joint is formed with said concrete mix and such intersecting elongate members, the number of said supporting members in the joint region being less than are required to provide said sufficient strength and ductility with concrete not containing any such fibers. The number of said supporting members may be zero.

The special concrete mix may be extended into a region beyond the joint region in at least one of the beam and column-type members with stirrups or stirrup-ties provided around the elongate members in the extended region, the number of said stirrups or stirrup-ties being less than are required to provide the necessary strength and ductility in said region with concrete not containing any such fibers.

6 Claims, 8 Drawing Figures

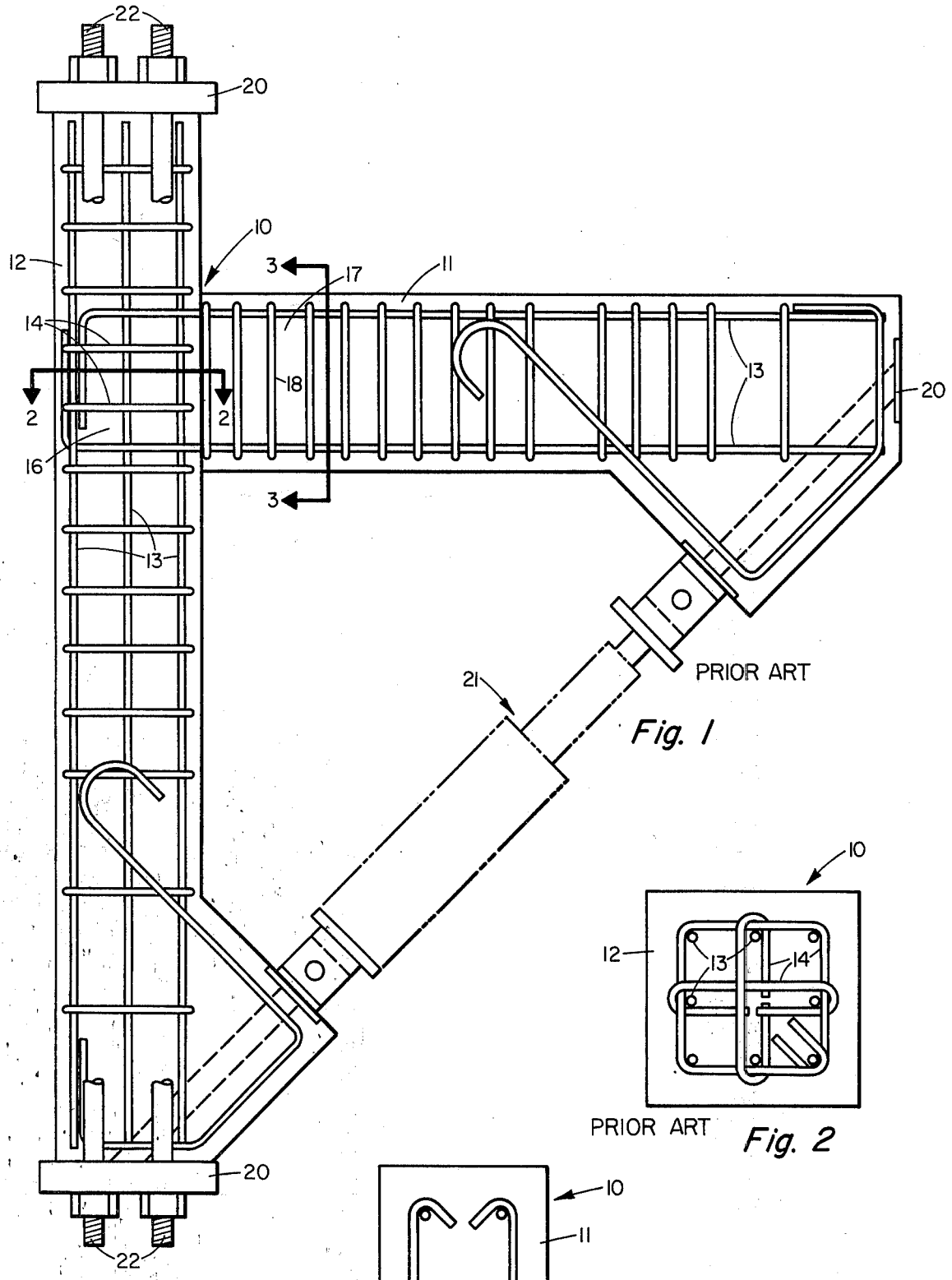
Fig. 1
PRIOR ART
Fig. 2
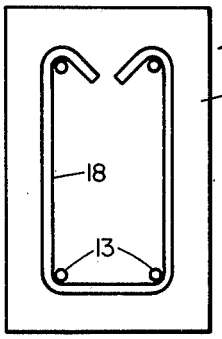
Fig. 3
PRIOR ART

CONCRETE JOINTS

BACKGROUND

Beam-column joints of "ductile concrete" for seismic-resistant structures are required to flex and absorb large amounts of energy during an earthquake. Frequently, the flexure is severe enough to cause concrete to crack and spall out of joints. Spalling in the joint can result in failure of the joint, ultimately leading to building collapse. To ensure that seismic joints maintain integrity through several cycles of reversed flexure, current practice is to place a maze of intersecting bars and hoop ties in the joint. Because of the amount of steel used, such joints show a ductile response to loading and the concrete is called ductile concrete.[1] The congestion produced by the steel, particularly the hoop ties, increases labor costs on the order of $100 per joint over ordinary joints and complicates concrete placement.

An object of the present invention is to provide a ductile concrete joint that minimizes the steel congestion common to such joints. An experimental comparison was conducted on two full-sized building frame sections—one using a conventional design in accordance with the latest seismic-resistant design specifications of the American Concrete Institute (ACI-318-71) and the other using a modified design which incorporated steel fibrous concrete in the critical stress region and used less reinforcing steel. In the joint region where the fibrous concrete was used, all of the column hoop ties were eliminated.

SUMMARY OF THE INVENTION

The present invention comprises typically, in a method of making a joint of beam and column-type members comprising essentially concrete of the type wherein intersecting elongate members of reinforcing steel or the like, confined with supporting members in the form of reinforcing hoops, stirrup-ties, supplementary crossties, or the like in the joint region, provide sufficient strength and ductility in the joint to withstand satisfactorily a predetermined amount of reversed flexure, the improvement that comprises preparing a concrete mix with fibers having a modulus of elasticity of at least about 20 million psi substantially uniformly distributed therein with an average spacing between fibers of up to about 0.3 inch and in a quantity sufficient to provide at least a predetermined flexural strength, and forming the joint with said concrete mix and said intersecting elongate members, the number of said supporting members in the joint region being less than are required to provide said sufficient strength and ductility with concrete not containing any such fibers. The number of said supporting members may be zero.

Said concrete mix may be extended into a region beyond the joint region in at least one of the beam and column-type members with stirrups or stirrup-ties being provided around the elongate members in the extended region, the number of said stirrups or stirrup-ties being less than are required to provide the necessary strength and ductility in said region with concrete not containing any such fibers.

The invention also comprises typically a joint of beam and column-type members comprising essentially concrete of the type wherein intersecting elongate members of reinforcing steel or the like, confined with supporting members in the form of reinforcing hoops, stirrup-ties, supplementary crossties, or the like in the joint region, provide sufficient strength and ductility in the joint to withstand satisfactorily a predetermined amount of reversed flexure, comprising a concrete mix with fibers having a modulus of elasticity of at least about 20 million psi substantially uniformly distributed therein with an average spacing between fibers of up to about 0.3 inch and in a quantity sufficient to provide at least a predetermined flexural strength, and such intersecting elongate members, the number of said supporting members in the joint region being less than are required to provide said sufficient strength and ductility with concrete not containing any such fibers. The number of said supporting members may be zero.

Said concrete mix may be extended into a region beyond the joint region in at least one of the beam and column-type members with stirrups or stirrup-ties provided around the elongate members in the extended region, the number of said stirrups or stirrup-ties being less than are required to provide the necessary strength and ductility in said region with concrete not containing any such fibers.

BRIEF DESCRIPTION OF THE DRAWINGS

FIG. 1 is a longitudinal sectional view, partially schematic, of a conventional joint of beam and column-type members, with loading apparatus connected thereto for use in testing.

FIG. 2 is a cross-sectional view taken in the plane 2—2 in FIG. 1 and in the plane 2—2 in FIG. 4.

FIG. 3 is a cross-sectional view taken in the plane 3—3 in FIG. 1 and in the plane 3—3 in FIG. 4.

DESCRIPTION OF PREFERRED EMBODIMENTS

Figure 4:
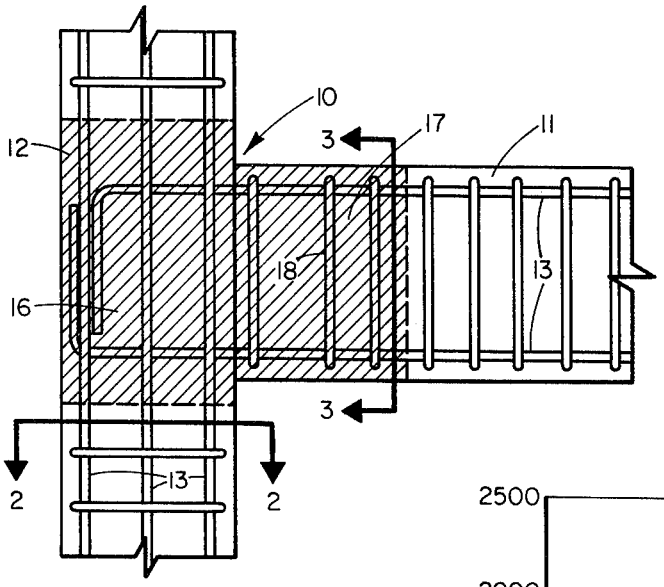
FIG. 4 is a view similar to FIG. 1 of a typical joint of beam and column-type members according to the present invention.

FIGS. 1 and 4 show typical joints 10 of beam and column-type members 11, 12 comprising essentially concrete of the type wherein intersecting elongate members 13 of reinforcing steel or the like, confined with supporting members 14 in the form of reinforcing hoops, stirrup-ties, supplementary crossties, or the like in the joint region 10, provide sufficient strength and ductility in the joint 10 to withstand satisfactorily a predetermined amount of reversed flexure. A typical joint 10 according to the present invention comprises a concrete mix 16 with fibers (too small to show in the drawings) having a modulus of elasticity of at least about 20 million psi substantially uniformly distributed therein with an average spacing between fibers of up to about 0.3 inch and in a quantity sufficient to provide at least a predetermined flexural strength, and such intersecting elongate members 13, the number of supporting members 14 in the joint region 10 being less than are required to provide said sufficient strength and ductility with concrete not containing any such fibers. In FIG. 4 the number of supporting members 14 is zero.

Details of a preferred method of determining the quantity of fibers to provide at least the predetermined flexural strength are given in the United States patent application of David R. Lankard, Ser. No. 260,654, filed June 7, 1972, for Improving Flexural Strength in Fiber-Containing Concrete, issued Oct. 19, 197 as Pat. No. 3,986,885.

Where the concrete mix 16 is extended into a region 17 beyond the joint region 10 in at least one of the beam and column-type members 11, 12 (as in the beam 11 of FIG. 4) and stirrups, stirrup-ties, or the like 18 are provided around the elongate members 13 in the extended region 17, the number of said stirrups, stirrup-ties, or the like 18 may be less than are required to provide the necessary strength and ductility in said region 17 with concrete not containing any such fibers (as in FIG. 1).

The present invention comprises typically, in a method of making a joint 10 of beam and column-type members 11, 12 comprising essentially concrete of the type wherein intersecting elongate members 13 of reinforcing steel or the like, confined with supporting members 14 in the form of reinforcing hoops, stirrup-ties, supplementary crossties, or the like in the joint region 10, provide sufficient strength and ductility in the joint 10 to withstand satisfactorily a predetermined amount of reversed flexure, the improvement that comprises preparing a concrete mix 16 with fibers (too small to show in the drawings) having a modulus of elasticity of at least about 20 million psi substantially uniformly distributed therein with an average spacing between fibers of up to about 0.3 inch and in a quantity sufficient to provide at least a predetermined flexural strength, and forming the joint 10 with the concrete mix 16 and such intersecting elongate members 13, the number of supporting members 14 in the joint region 10 being less than are required to provide said sufficient strength and ductility with concrete not containing any such fibers. As in FIG. 4, the number of said supporting members may be zero.

Where the concrete mix 16 is extended into a region 17 beyond the joint region 10 in at least one of the beam and column-type members 11, 12 (as in the beam 11 of FIG. 4) and stirrups, stirrup-ties, or the like 18 are provided around the elongate members 13 in the extended region 17, the number of said stirrups, stirrup-ties or the like 18 may be less than are required to provide the necessary strength and ductility in said region 17 with concrete not containing any such fibers (as in FIg. 1).

EXAMPLES

Two beam-column joints were made, as in FIGS. 1 and 4. Each joint 10 consisted of an 8-inch wide by 12-inch deep beam 11 framed into a 10-inch square column 12. As-built details of the joints are shown in FIG. 1. Load pads 20 were provided near the ends of the beams and columns to allow loading by a double-acting hydraulic cylinder 21.

The conventional ductile joint 10 as in FIG. 1 was designed in accordance with American Concrete Institute Standard ACI 318-71, "Building Code Requirements for Reinforced Concrete," Appendix A - Special Provisions for Seismic Design. The fibrous concrete joint 10 as in FIG. 4 was the same except that the four column hoops 14 with supplementary crossties as in FIG. 2 in the joint area were eliminated. Also, the spacing of the stirrups 18 was increased in the part 17 of the beam where the fibrous concrete was placed (out to 10 inches from the column face). Stirrups and stirrup ties 18 for the conventional joint beam 10 in FIG. 1 were spaced at $2\frac{1}{2}$ inches for a distance of $22\frac{1}{2}$ inches from the face of the column. For the fibrous concrete joint 10 in FIG. 4, three stirrups 18, spaced at approximately 4 inches were used in the fibrous concrete part of the beam 11 followed by stirrups at $2\frac{1}{2}$ inches for the remaining distance to $22\frac{1}{2}$ inches.

Design values for materials were:

Beam concrete — $f_c' = 3000$ psi, $\frac{3}{4}$ inch maximum size aggregate

Beam Bars — $f_y = 40{,}000$ psi (ASTM A-615-68 Gr. 40)

Column Concrete — $f_c' = 5000$ psi, $\frac{3}{8}$ inch maximum size aggregate

Column Bars — $f_y = 60{,}000$ psi (ASTM A-615-68 Gr. 60)

Fibrous Concrete — 1400 psi ultimate flexural strength at 28 days, 5000 psi compressive strength at 28 days — $\frac{1}{4}$ inch maximum size aggregate, 1.67% by volume of 0.020 inch diameter by $1\frac{1}{2}$ inch long steel fibers. The column 12 was designed to be stronger than the beam 11 so that plastic hinges would form in the beam rather then the column. Reinforcing for the beam consisted of two No. 7 bars (ASTM Designation A615-68T, 0.875 inch diameter) top and bottom for a reinforcement ratio ($\rho = (As/bd)$ of 0.0154. Using the actual as-built dimensions, the known concrete properties, (5105 psi), and the specified $f_y$ of 40,000 psi, the ultimate design resisting moment of the beam was calculated by ACI 318-63 Eq. (16-1) $Mu = \phi\,[bd^2 f_c' q\,(1-0.59\,q)] = \phi\,[A_s f_y\,(d-a/2)]$ to be 37.2 ft-Kips for both positive and negative bending moments. The column steel consisted of eight No. 7 bars, providing 4.81% steel (ACI 318-71 limits are 1% minimum, 6% maximum).

For the conventional joint, hoop ties of No. 5 bars (ASTM Designation, A 615-68, 0.625 inch diameter) at 4-inch spacing with 2 supplementary crossties of No. 5 bars for each hoop were provided for the joint region of the column and for a distance of at least 18 inches from the face of the connection. Because one supplementary crosstie had to fit over the other crosstie, fabrication to provide the 4-inch spacing was extremely difficult.

The ultimate column load, $P_o$, was calculated by ACI 318-63 Eq. (19-7) $P_o = \phi\,[0.85\,f_c'\,(A_g - A_{st}) + A_{st} f_y]$ to be 693.2 Kips. The ultimate resisting moment of the column was calculated by ACI 318-63 Eq. (16-1) to be 55.9 ft-Kips (1 ft-Kip equals 1000 ft-lbs).

Figure 5:
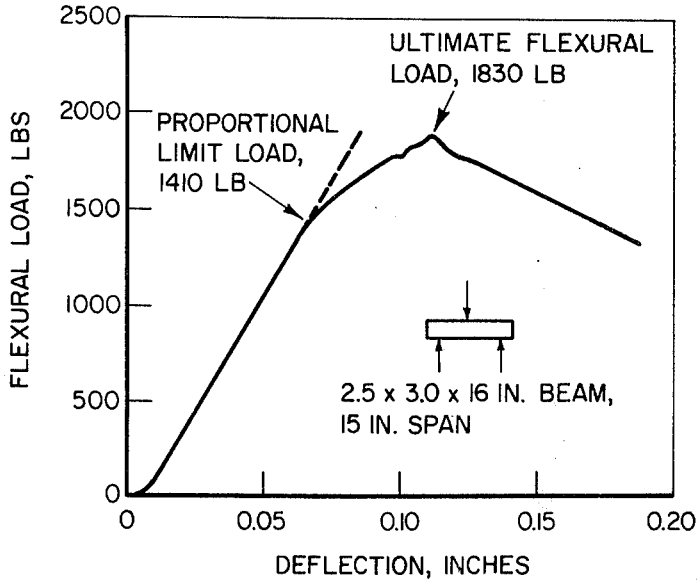
FIG. 5 is a graph of flexural load against deflection for a small beam specimen of steel fibrous concrete, illustrating the ductility of steel fibrous concrete.

Selection of the modified design where the hoop ties were left out of the joint region was based on the fact that the fibrous concrete possesses a flexural strength in the range of 800 psi to 2500 psi (depending on wire content), possesses a high shear strength, typically 500 psi to 600 psi, and exhibits a large energy absorption capacity and ductility in flexure. FIG. 5 shows a typical load-deflection diagram of a flexural test of steel fibrous concrete. The data were obtained on a 1.0 cement/2.4 sand mortar mix containing 2 percent by volume of 0.010-in. (0.025-cm) diameter by 1-in. (2.5-cm) long steel fiber, cured 28 days in fog and air-dried 1.5 years under normal laboratory conditions of ambient temperature (about 72 ± 3 F), pressure, and relative humidity (about 30–50%).

Figure 6:
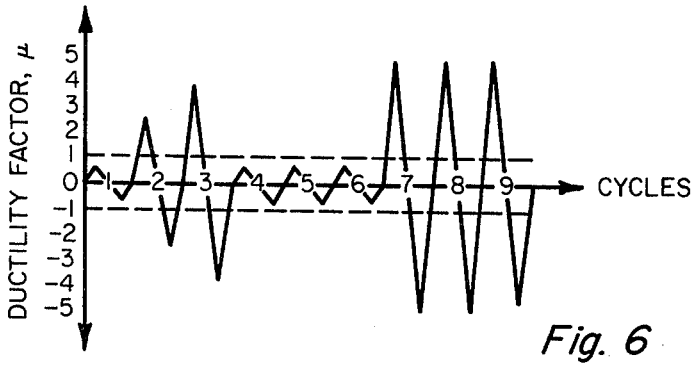
FIG. 6 is a graph of ductility factor against loading cycles, wherein the loading simulated the effect of two major earthquakes on the joints of FIGS. 1 and 4.

The fabrication, instrumentation and testing of the two joints used methods and procedures modeled after a similar testing program by the Portland Cement Association (PCA) Structural Laboratory,[2] but using equipment that was more compact. The earthquake representation used was the same as that used by the PCA. This loading sequence, as in FIG. 6, used a slow loading (approximately 15 minutes for one-half of a loading cycle) which is considered conservative as a basis for testing seismic specimens. As noted in the above-referenced study: "The loading cycles shown in FIG. 6 were chosen to represent the effect of two major earthquakes. The purpose of the first loading cycle is to establish the elastic rotation of the connection. The next 2 cycles represent the first earthquake of major magnitude. The next three cycles establish the stiffness of the structure under loads well above the design working stresses but less than the ultimate. The last three cycles simulate a second major earthquake. Ductility factors of 2.5, 4.0, and 5.0 are used for the yield excursions of cycles 2, 3, and 7 to 9, respectively. Cycles 1, 4, 5 and 6 are so-called elastic cycles to 75% of yield load."[2]

The ductility factor, $\mu$, is defined as the ratio of the rotation at a particular load to the rotation at yield load, i.e., $$\mu = \frac{\text{total rotation (radians)}}{\text{rotation at yield (radians)}}$$

Concrete for the specimens used Type II Portland Cement, local Columbia River sand (at Richland, Washington) and ⅜-inch or ¾-inch maximum size aggregate. The ⅜-inch aggregate was used for the column because of the congested steel. The beam concrete used ¾-inch aggregate. For the fibrous concrete the same sand and cement were used but no coarse aggregate was used. Fibers were 0.020-inch diameter by 1½ -inches long, brass-plated steel having an ultimate tensile strength in the range of 135,000 psi to 200,000 psi. Table I shows the mix design for the fibrous concrete. Material properties obtained from compressive test cylinders and flexural test beams are shown in Table II.

Steel reinforcing bars conformed to ASTM A-615-68 grade 40 for the beams and grade 60 for the columns.

The specimens were cast in plywood forms with beams and columns laying flat on the floor with the area for fibrous concrete blocked out for the modified joint. A form oil was applied, and the prefabricated cages of beam and column reinforcement were placed in the forms. The column concrete was cast first followed in 15 minutes by the beam concrete. One hour later the fibrous concrete was placed in the modified joint. All concrete was consolidated by an immersion-type vibrator. For a period of seven days, the specimens were moist-cured in the forms under polyethylene sheeting. Then the forms were stripped and specimens were exposed to room air at 70° to 75° F and 30 to 50% R.H.

The conventional joint was tested 28 days after casting, and the modified joint 29 days after casting. Loads to produce the moments were applied by a 100-ton capacity hydraulic jack mounted at 45° to the members. Positive and negative bending moments were alternately applied to produce the ductility factors shown in FIG. 6 over the 9 cycles. A tenth cycle was added to find, if possible, what ductility factor each specimen could attain and still remain a serviceable joint, i.e., have an acceptable damage level and still maintain the applied load. The loading was continued until the capacity of the deflection measuring equipment was reached. After the excursions to $\mu = 8.5$ for the conventional joint and $\mu = 13.5$ for the modified joint (in the 10th cycle), both joints were holding a load at least equal to the maximum reached previously and the damage had consisted of concrete cracking only. Neither joint showed loss of concrete from spalling.

TABLE 1.

FIBROUS CONCRETE MIX USED IN THE MODIFIED JOINT REGION

| Ingredient | Amount, lbs/cu. yd (SSD Basis) |
|---|---|
| Sand (¼" minus concrete sand) | 2332 |
| Portland Cement (Type II ASTM C150-71) | 972 |
| Water | 413 |
| Steel Fibers (0.020" dia × 1 ½" long) | 221 |
| Water Reducing Agent (Protex Dispersing Agent, PDA-25XL) | 3.0 fl oz/ sack of cement |

SSD = saturated surface - dry, ASTM C127-68
Protex PDA-25XL is a water-reducing admixture manufactured by Protex Industries, Denver, Colorado, conforming to ASTM Designation C494-71, Type A, and consisting essentially of purified and desugared ligno-sulphonate containing no calcium chloride.
Gradation of the sand was:

| Standard Sieve Size (ASTM Ell-70) | Percent Passing |
|---|---|
| No. 4 | 97 |
| No. 8 | 87 |
| No. 16 | 71 |
| No. 30 | 47 |
| No. 50 | 16 |
| No. 100 | 6 |
| No. 200 | 2.4 |

TABLE II.

MATERIAL PROPERTIES OF CONCRETE USED IN THE JOINT SPECIMENS

| Concrete Location in the Specimen | Concrete Compressive Strength, psi[1] | Concrete Flexural Strength, psi[2] |
|---|---|---|
| Nominal 3000 psi concrete used for both beams | 5105[3] | 544[4] |
| Nominal 5000 psi concrete used for both columns and in the conventional joint region | 4916[3] | 450[4] |
| Fibrous concrete used in the modified joint region | 5640[5] | 1419[4] |

[1]Per ASTM C 39-71, 6" × 12" cylinders at 27 days
[2]Per ASTM C 78-64, 4" × 4" × 14" beams, third point loading on 12" span at 27 days
[3]Average of 3 cylinders
[4]Average of 3 beams
[5]Average of two cylinders Prior to testing the specimens, a load equal to approximately Po/4 (177 Kips) was applied to the column by means of the external rods 22. This load represented a column load in lower stories of a building frame.

The up-load and down-load portions of a loading cycle were applied by increasing the pressure in the hydraulic system 21 to a predetermined load or beam rotation in about 8 steps to obtain data points for the moment-rotation diagrams. Return to zero was accomplished by release of oil pressure to zero in about 8 steps.

Cycle 1 for each specimen consisted of loading the joint to approximately 75% of the computed yield moment in each directon. Straight line extrapolation of the curve from 0 to 50% of the computed yield moment to 100% computed yield moment was used to define elastic rotation at yield.

Loads in the external rods 22 were calculated from elongation in a 66-inch gage length measured by a fixed length trammel and micrometer dial calipers. Loads applied to the joints were calculated from readings of a pressure gage, calibrated as a test gage to ± ¼ of 1% accuracy. Beam hinge rotation was measured by a dial gage indicating the deflection of a steel angle frame attached to the beam at a distance of 12 inches from the column face. The distance from the beam centerline to the dial gage was 20 inches. Simultaneous readings of the hydraulic oil pressure and deflection were fed into a Hewlett-Packard 9100B calculator and 9125A calculator-plotter to allow plotting of the moment-rotation diagrams during the tests.

Figure 7:
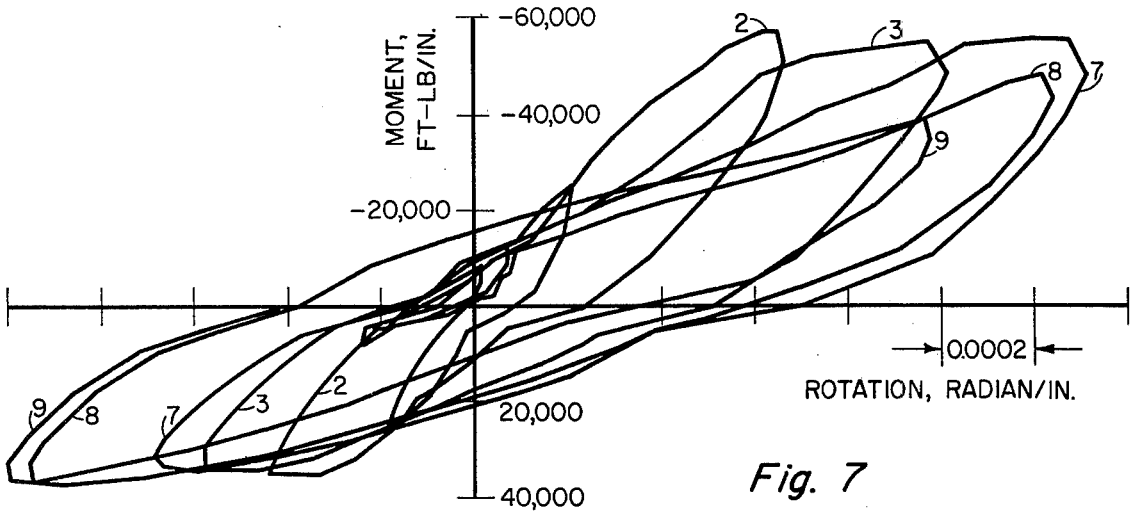
FIG. 7 is a moment-rotation diagram for the joint in FIG. 1.
Figure 8:
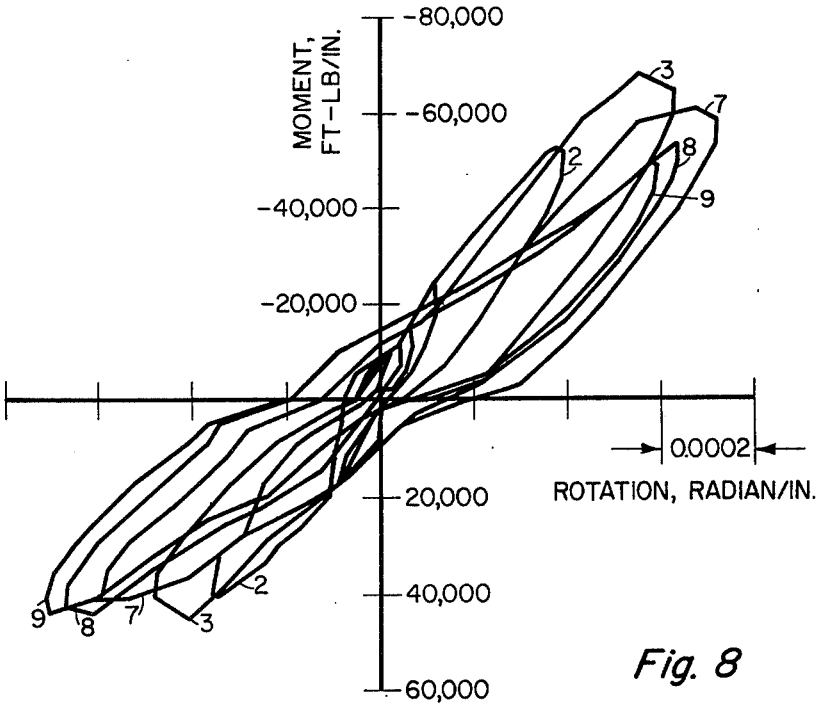
FIG. 8 is a moment-rotation diagram for the joint in FIG. 4.

Moment-rotation diagrams for the two specimens, as plotted by the calculator-plotter, are shown in FIGS. 7 and 8. Since the amount of steel was the same in the top and bottom of the beam, the moment capacity would be approximately the same for positive and negative moment. However, because the moment-inducing loads were applied at 45°, the up load added an axial tension load to the beam and the down load added an axial compression load to the beam. As shown in FIGS. 7 and 8, these axial loads caused an apparent decrease in the positive moment capacity (beam convention, considering moment to be positive when bottom of beam is in tension) and an apparent increase in the negative moment capacity of the beams. Actual moment capacity for a cycle is the average of the absolute values of the positive and negative moments attained in a cycle.

Since axial loads could be expected to occur during an earthquake from horizontal and vertical accelerations, the earthquake representation obtained from the 45° loading is believed to be as valid a representation as one using purely vertical forces to induce moments.

Comparison of the two moment-rotation charts shows that the joint of FIG. 4 was stiffer (rotated a lesser amount under the same moment) than the conventional joint of FIG. 1 and that it obtained a higher ultimate moment capacity. The maximum moment capacity developed by the conventional joint occurred in cycles 2 ($\mu = 2.5$) and 7 ($\mu = 5.0$) and was $\pm$ 45.9 ft-Kips. The modified joint (FIG. 4) developed a maximum moment of $\pm$ 56.6 ft-Kips in cycle 3 ($\mu = 4.0$).

During cycle 10, at a $\mu$ of 13.5, the modified joint of FIG. 4 developed a moment capacity of $\pm$ 57.7 ft-Kips, slightly higher than the maximum developed in the first 9 cycles. The moment developed by the conventional joint of FIG. 1 during cycle 10 ($\mu = 8.5$) was $\pm$ 45.9 ft-lbs, the same as the maximum developed in the first 9 cycles.

Both the conventional joint and the modified joint performed very well in the function of confining the concrete in the joint region.

For the conventional joint, the major beam cracking occurred in the first 6 to 8 inches of the beam next to the column. One major crack occurred at the intersection line of the beam and column. There were some hairline cracks in the joint region in the column.

For the modified joint, most major beam cracking occurred outside of the region where the fibrous concrete was placed. One major crack occurred in the region two to four inches from the column face. There were no cracks in the joint region in the column of the modified joint. The modified joint appeared to be more damage tolerant and resisted cracking better than the conventional joint, particularly in the critical stress areas, i.e., the joint region in the column and the intersection line of the beam and column.

The modified joint, using fibrous concrete to replace the joint region hoop ties, shows good ductility and is as least as strong and damage tolerant as a conventional ductile concrete joint and somewhat stiffer. In building construction using the modified joint fabrication of the steel is simpler and placing of the concrete into the joint area is easier because of the reduction of steel congestion. This can reduce building costs by an estimated $100 per joint. Also, fewer stirrups may be used in concrete beams where the fibrous concrete is used.

The advantageous use of fibrous concrete in beam-column joints is not limited to seismic design. Other building joints, particularly those requiring hoops because of unusual loads, can also benefit from its use.

The following symbols have been used herein:

Ag = gross area of section, in.$^2$ $A_s$ = area of non-prestressed tension reinforcement, in.$^2$ $A_{st}$ = total area of longitudinal reinforcement, in.$^2$ $a = A_s f_y / 0.85\, f_c' b$ $b$ = width of compression face of member, in.

$d$ = distance from extreme compression fiber to centroid of non-prestressed tension reinforcement, in.

$f_c'$ = compressive strength of concrete, psi $f_y$ = specified yield strength of non-prestressed reinforcement, psi $q = \rho f_y / f_c'$ $\mu$ = (total rotation/yield rotation) = the ratio of the rotation at a particular load to the rotation at yield load $\phi$ = capacity reduction factor = 0.90 for flexure and 0.70 for tied compression members.

$\rho = A_s/bd$, ratio of non-prestressed tension reinforcement $P_o$ = ultimate compressive load capacity of the column, Kips (1 Kip equals 1000 lbs)

REFERENCES

[1] Blume, J. A., Structural Dynamics in Earthquake Resistant Design, Trans. ASCE, 125, 1088–1139 (1960).

[2] Hanson, N. W., and Conner, H. W., "Seismic Resistance of Reinforced Concrete Beam-Column Joints," Journal of the Structural Division, ASCE, Vol. 933, ST5, Proc. Paper 5337, Oct. 1967, pp. 553-60; PCA Development Department Bulletin D121.

While the forms of the invention herein disclosed constitute presently preferred embodiments, many others are possible. It is not intended herein to mention all of the possible equivalent forms or ramifications of the invention. It is to be understood that the terms herein are merely descriptive rather than limiting, and that various changes may be made without departing from the spirit or scope of the invention.

I claim:

1. In a method of making a joint of beam and column-type members of the type comprising essentially concrete and intersecting elongate members of reinforcing steel or the like, confined with supporting members in the form of reinforcing hoops, stirrup-ties, supplementary crossties, or the like in a joint region, to provide sufficient strength and ductility in the joint to withstand satisfactorily a predetermined amount of reversed flexure, the improvement that comprises providing a stiffer joint than the aforesaid joint by preparing a concrete mix with fibers having a modulus of elasticity of at least about 20 million psi substantially uniformly distributed therein with an average spacing between fibers of up to about 0.3 inch and in a quantity sufficient to provide at least a predetermined flexural strength and forming the joint in the joint region with said concrete mix and such intersecting elongate members and a number of said supporting members in the joint region less than are required to provide said sufficient strength and ductility with concrete not containing any such fibers, the quantity of said fibers in the joint region having less weight and volume than the omitted supporting members.

2. A method as in claim 1, wherein the number of said supporting members is zero.

3. A method as in claim 1, wherein said concrete mix is extended into a region beyond the joint region in at least one of the beam and column-type members and stirrups or stirrup-ties are provided around the elongate members in the extended region, the number of said stirrups or stirrup-ties being less than are required to provide the necessary strength and ductility in said region with concrete not containing any such fibers.

4. In a joint of beam and column-type members of the type comprising essentially concrete and intersecting elongate members of reinforcing steel or the like, confined with supporting members in the form of reinforcing hoops, stirrup-ties, supplementary crossties, or the like in a joint region, to provide sufficient strength and ductility in the joint to withstand satisfactorily a predetermined amount of reversed flexure the improvement of a joint possessing greater stiffness than the aforesaid joint through comprising in the joint region a concrete mix with fibers having a modulus of elasticity of at least about 20 million psi substantially uniformly distributed therein with an average spacing between fibers of up to about 0.3 inch and in a quantity sufficient to provide at least a predetermined flexural strength, and such intersecting elongate members and a number of said supporting members in the joint region less than are required to provide said sufficient strength and ductility with concrete not containing any such fibers, the quantity of said fibers in the joint region having less weight and volume than the omitted supporting members.

5. A joint as in claim 4, wherein the number of said supporting members is zero.

6. A joint as in claim 4, wherein said concrete mix is extended into a region beyond the joint region in at least one of the beam and column-type members and stirrups or stirrup-ties are provided around the elongate members in the extended region, the number of said stirrups or stirrup-ties being less than are required to provide the necessary strength and ductility in said region with concrete not containing any such fibers.

* * * * *